United States Patent [19]

Barney et al.

[11] 4,028,265

[45] June 7, 1977

[54] PROCESS FOR CONVERTING SODIUM NITRATE-CONTAINING, CAUSTIC LIQUID RADIOACTIVE WASTES TO SOLID INSOLUBLE PRODUCTS

[75] Inventors: Gary S. Barney; Lloyd E. Brownell, both of Richland, Wash.

[73] Assignee: The United States of America as represented by the United States Energy Research and Development Administration, Washington, D.C.

[22] Filed: Aug. 25, 1975

[21] Appl. No.: 607,853

Related U.S. Application Data

[63] Continuation-in-part of Ser. No. 457,325, April 2, 1974.

[52] U.S. Cl. ..... 252/301.1 W

[51] Int. Cl.[2] ..... G21F 9/16

[58] Field of Search ..... 252/301.1 W, 301.1 R; 423/118

[56] References Cited

UNITED STATES PATENTS

| | | | |
|---|---|---|---|
| 3,000,072 | 9/1961 | Evans | 252/301.1 W |
| 3,274,784 | 9/1966 | Shock et al. | 252/301.1 W |

OTHER PUBLICATIONS

Barrer et al., "Chemistry of Soil Minerals", J. Chem. Soc. (A), 1968, pp. 2475–2485.

White et al., "Ultimate Fission Product Disposal", At. En. Can. Ltd., Chalk River Project No. 391,22 as abstracted in Chem. Abs. 32:17997i.

Stecher et al. Eds. The Merck Index, Merck & Co., Inc. (Rahway, N. J. 1968) "Ethyl Silicate", p. 441.

Durham et al., "Durability of Some Silicate Glasses . . .", At. Ener. Can. Ltd. Chalk River Proj. No. 818 from Chem. Abstracts 53:17459g.

Amphlett, C. B., *Treatment and Disposal of Radioactive Waste*, (Pergammon Press, New York, 1961) pp. 93–102.

*Primary Examiner*—Benjamin R. Padgett
*Assistant Examiner*—Deborah L. Kyle
*Attorney, Agent, or Firm*—Dean E. Carlson; Robert M. Poteat; Robert K. Sharp

[57] ABSTRACT

A method for converting sodium nitrate-containing, caustic, radioactive wastes to a solid, relatively insoluble, thermally stable form is provided and comprises the steps of reacting powdered aluminum silicate clay, e.g., kaolin, bentonite, dickite, halloysite, pyrophyllite, etc., with the sodium nitrate-containing radioactive wastes which have a caustic concentration of about 3 to 7 M at a temperature of 30° C to 100° C to thereby entrap the dissolved radioactive salts in the aluminosilicate matrix.

In one embodiment the sodium nitrate-containing, caustic, radioactive liquid waste, such as neutralized Purex-type waste, or salts or oxide produced by evaporation or calcination of these liquid wastes (e.g., anhydrous salt cake) is converted at a temperature within the range of 30° C to 100° C to the solid mineral form-cancrinite having an approximate chemical formula $2(NaAlSiO_4) \cdot xSalt \cdot y\ H_2O$ with $x = 0.52$ and $y = 0.68$ when the entrapped salt is $NaNO_3$. In another embodiment the sodium nitrate-containing, caustic, radioactive liquid is reacted with the powdered aluminum silicate clay at a temperature within the range of 30° C to 100° C, the resulting reaction product is air dried eitheras loose powder or molded shapes (e.g., bricks) and then fired at a temperature of at least 600° C to form the solid mineral form-nepheline which has the approximate chemical formula of $NaAlSiO_4$.

The leach rate of the entrapped radioactive salts with distilled water is reduced essentially to that of the aluminosilicate lattice which is very low, e.g., in the range of $10^{-2}$ to $10^{-4}$ g/cm$^2$ — day for cancrinite and $10^{-3}$ to $10^{-5}$ g/cm$^2$ — day for nepheline.

7 Claims, No Drawings

PROCESS FOR CONVERTING SODIUM NITRATE-CONTAINING, CAUSTIC LIQUID RADIOACTIVE WASTES TO SOLID INSOLUBLE PRODUCTS

BACKGROUND OF THE INVENTION

The invention described herein was made in the course of, or under, a contract with the United States Atomic Energy Commission.

This application is a continuation-in-part of application Ser. No. 457,325 filed Apr. 2, 1974.

The present invention relates to a method of immobilizing radioactive in a solid, virtually insoluble, thermally stable product and more specifically to a member of converting sodium-containing radioactive wastes to a salt-filled virtually insoluble thermally stable mineral form with radioactive salts trapped in the aluminosilicate structure.

In the earlier synthesis studies Barrer and co-workers, for example, prepared non-radioactive salt-filled cancrinites and sodalites by reacting a small quantity (2 g.) of kaolinite in 200 ml NaOH (4M) solution pulse various sodium salts, such as $NaHO_3$, $Na_2SO_4$, $Na_2CrO_4$, etc., at 80° C for 5 days. It was found that in all cases the salts were entrained in the aluminosilicate lattice. For a more complete description of this early work see, for example, the article "Chemistry of Soil Minerals, Part IV. Low Temperature Hydrothermal Transformation of Kaolinite" by R. M. Barrer et al, *J. Chem. Soc.* (*A*), 1968, 2475 (1968). Also, see later articles by R. M. Barrer et al (1) "Hydrothermal Chemistry of Silicates. Part XV. Synthesis and Nature of Some Salt-Bearing Aluminosilicates," *J. Chem. Soc.* (*A*), 1970, 2735, (1970), (2) "Chemistry of Soil Minerals. Part VI. Salt Entrainment by Sodalite and Cancrinite During Their Synthesis, " *J. Chem. Soc.*, 1970, 1516 (1970) and (3) "Chemistry of Soil Minerals, Part VII, Synthesis, Properties and Crystal Structure of Salt-Filled Cancrinites," *J. Chem. Soc.* (*A*1970, 1523 (1970).

In copending application Ser. No. 265,041 filed on June 21, 1972, there was disclosed a method for immobilizing radionuclides in a highly insoluble complex metalosilicate, such as pollucite ($Cs_2O.Al_2O_3.4\ SiO_4$), by reacting radioactive waste as calcined oxides or oxide slurries with clays such as kaolinite or bentonite.

It is highly desirable to provide a method of converting sodium nitrate-containing, caustic, liquid, radioactive wastes to a solid product form which is virtually insoluble and thermally stable.

SUMMARY OF THE INVENTION

We have found that sodium nitrate-containing, caustic, liquid, radioactive wastes can be converted to a solid, salt-filled, radioactive mineral form of either cancrinite or nepheline by reacting powdered aluminum silicate clay selected from the group consisting of kaolin, bentonite, dickite, halloysite, or pyrophyllite with aqueous solutions or slurries of said caustic radioactive wastes which have a caustic concentration of about 3 to 7M at a temperature within the range of 30° C to 100° C to thereby entrap radioactive isotopes, e.g., $Cs^+$, $Sr^{++}$, etc., in the aluminosillicate framework structure.

In one embodiment caustic, sodium nitrate-containing, radioactive waste, e.g., a Purex-type radioactive waste containing $4.60 \times 10^5 \mu$ ci/liter $^{137}Cs$ was converted to a hard ceramic mass of cancrinite crystals which is stable to a temperature of about 800° C in about 3 hours reaction with powdered aluminum silicate clays; the solid cancrinite which contained the trapped cesium ions had leach rates within the range of $10^{-2}$ to $10^{-4}$ - day.

In another embodient sodium nitrate-containing, caustic, radioactive waste is converted to nepheline by reacting the radioactive waste with powdered aluminum silicate clay at a temperature within the range of 30° C to 100° C, air drying the reaction product followed by firing to at least 600° C. The solid nepheline which contained trapped cesium had leach rates within the range of $10^{-3}$ to $10^{-5}$ g/cm$^2$ - day.

The process is simple and requires no outside heat input to immobilize the radioactive salts in cancrinite. In addition, the clay reagents are relatively inexpensive and readily available. The solid product exhibits exceptionally low leachability.

DESCRIPTION OF THE PREFERRED EMBODIMENTS

The present process can be applied to a wide variety of sodium-containing, caustic, radioactive liquid wastes, such as neutralized Purex wastes or to salts or oxides produced by evaporation or calcination of these liquid wastes e.g., anhydrous salt cake. Salts or oxides as aqueous solutions or slurries may also be converted to cancrinite or nepheline in accordance with this process. The invention will, for ease of understanding, be hereinafter described with reference to converting caustic, Purex-type liquid wastes to solid cancrinite or nepheline.

The powdered aluminum silicate clays useful in this process are selected from the group consisting of kaolin, bentonite, dickite, halloysite or pyrohillite. Typical compositions, for example, for kaolin and bentonite are given in Table I below:

TABLE I

ANALYSIS OF CLAY REAGENTS

| Component | Weight percent of component in Kaolin[a] | Kaolin[b] | Bentonite[c] | Bentonite[d] |
|---|---|---|---|---|
| $SiO_2$ | 46.20 | 43.97 | 54.74 | — |
| $Al_2O3$ | 38.06 | 41.93 | 19.25 | 15.83 |
| $Na_2O$ | 0.067 | 0.220 | 3.51 | 3.27 |
| FeO | 0.36 | — | 3.60 | — |
| MgO | 0.041 | — | 2.84 | — |
| CaO | 0.0007 | — | 0.14 | — |
| $H_2O$ | 11.7 | 13.4 | 11.1 | 10.6 |

[a]ignited kaolin (J. T. Baker Chemical Company)
[b]ignited kaolin (Georgia Kaolin Company)
[c]dried Wyoming bentonite (Robinson Laboratories)
[d]dried bentonite (Georgia Kaolin Company)

It is preferred that the clays be dried in order to reduce the volume and moisture content of the product. Firing the clays at 600° C for 48 hours is quite suitable.

In one embodiment of this invention powdered clay is reacted with the liquid radioactive waste at a temperature in the range of 30° C to 100° C to convert the liquid waste to a solid crystalline product, cancrinite. It is important to the successful carrying out of this process that the waste must contain sufficient caustic (e.g., 3 to 7 M) to react with the clay and nitrate salts, which are present in the reaction mixture. This reaction, as typified with kaolin, is given for the conversion to cancrinite by the equation:

$$Al_2Si_2O{\cdot}2H_2O + 2N_aOH + 0.52\ NaNO_3 + 0.68H_2O \rightarrow Na_2O{\cdot}Al_2O_3{\cdot}2SiO_2{\cdot}0.68H_2O{\cdot}0.52\ NaNO_3 + 3H_2O. \quad (1)$$

The stoichiometry for kaolin requires two moles of NaOH for each mole of cancrinite formed. Inasmuch as bentonite has a higher number of moles of silicon than aluminum (Si/Al = 2), one mole of added $NaAlO_2$ per mole bentonite is required for the bentonite reaction to bring the Si/Al molar ratio up to the same as the product. Thus, the stoichiometry for the bentonite reaction mixture (i.e., containing $NaAlO_2$) requires also two moles of NaOH for each mole of cancrinite formed. It should be noted that with either kaolin or bentonite the maximum moles of salt which can be entrapped in the aluminosilicate framework structure is 0.52 moles per mole cancrinite formed.

In a similar manner it has been found that sodium nitrate-containing, caustic, radioactive waste could be converted to the solid mineral form nepheline ($NaAlSiO_4$) which is also virtually insoluble and thermally stable as is the case with the salt-filled cancrinite product. For the nepheline conversion the reaction product of the powdered aluminum silicate clay and sodium nitrate-containing, radioactive waste is additionally treated by air drying and then fired at a temperature of at least 600° C to produce the thermally stable nepheline with entrapped radioactive salts. The solid nepheline product may be prepared as a loose powder or as shaped objects (e.g., bricks), the latter of which may be conveniently formed by compressing the reaction product from the clay/waste reaction into the desired shape.

The conversion of sodium nitrate-containing, caustic radioactive waste to nepheline is effected by calcinating according to the general equation:

$$Na_2O{\cdot}Al_2O_3{\cdot}2SiO_2{\cdot}0.68H_2O{\cdot}0.52NaNO_3 \overset{\Delta}{\rightleftharpoons} 2NaAlSiO_4{\cdot}0.26Na_2O + 0.68H_2O + 0.26N_2O_5 \quad (2)$$

The amount of NaOH which reacts with a given amount of clay was determined by reacting the clay (5.0 grams) with solutions containing various concentrations of NaOH and a constant of $NaNO_3$ which is necessary for the formation of cancrinite. The results are given in Table II below:

TABLE II

THE EFFECT OF NaOH CONCENTRATION ON THE EXTENT OF REACTION[a]

| Run No. | Clay | NaOH M | % NaOH Used up[b] | % $NaNO_3$ Trapped[c] | % Clay Reacted[c] | % Zeolytic Water[c] |
|---|---|---|---|---|---|---|
| 1 | Bentonite | 1.0 | 90.6 | 36 | — | — |
| 2 | bentonite | 2.0 | 63.0 | 0 | — | — |
| 3 | bentonite | 3.0 | 40.7 | 0 | — | — |
| 4 | bentonite | 4.0 | 52.0 | 0 | — | — |
| 5 | bentonite | 5.0 | 47.0 | 0 | — | — |
| 6 | kaolin | 1.0 | 100.0 | 18 | 15 | 0 |
| 7 | kaolin | 2.0 | 100.0 | 29 | 31 | 0 |
| 8 | kaolin | 3.0 | 100.0 | 41 | 37 | 0 |
| 9 | kaolin | 4.0 | 100.0 | 46 | 51 | 2.1 |
| 10 | kaolin | 5.0 | 100.0 | 54 | 62 | 2.4 |

[a]five ml of 2.0M $NaNO_3$ at the given NaOH concentration were used in each reaction mixture and each mixture was heated for 11 days at 100° C.
[b]from analysis of the filtrate.
[c]from the thermogravimetric analyses.

It will be apparent from the data that essentially all of the NaOH in the waste solutions reacted with kaolin. Bentonite does not react as completely with the NaOH under these conditions.

In contrast to other processes for immobilizing radioactive waste the present process can be conducted at low temperature, i.e., below 100° C. For example the reaction for forming cancrinite is completed after 3 hours at 100° C. Temperature above 100° C may be practical to immobilize the radioactive waste in cancrinite if carried out in pressure vessels. As noted herein before, the conversion to the thermally stable nepheline requires a final firing step of 600° C or above.

There is a large temperature effect on the reaction rate. The half-times for the reaction of kaolin with the standard liquid waste at 100° C, 75° C, and 50° C are, respectively, 1, 10 and 150 hours. The corresponding half-times for the bentonite reaction are 1, 9 and 60 hours.

In applying the clay reaction process to liquid wastes the minimum amount of clay needed to completely solidify the waste consideration. This, of course, will determine the volume of solidified waste which must be handled and stored. The volume of clay and waste appear to be additive since the density of the clays calculated from the volume increases (2.63 g/ml) is near that of the actual density (2.59 g/ml). The minimum volume increase for complete solidification of the waste depends on the type of waste to be solidified. For concentrated, neutralized Purex waste the minimum volume increase is about 32% for bentonite and about 28% for kaolin. This corresponds to about 0.84 g bentonite and 0.70 g kaolin per milliliter of waste solution, respectively. Fired clays appear to give the smallest volume increase (as low as 20% for the Purex-type waste solution).

The process may be practiced over a wide range of clay/waste solution ratios. Reactions, for example, over a range of 0.05 to 2.0 grams of bentonite/ml of solution gave cancrinite (plus unreacted bentonite at the higher ratios). A range of 0.05 to 1.0 g kaolin/ml of solution also gave cancrinite.

The solid cancrinite which is in the form of small crystals ~ 0.5 μm in diameter has excellent chemical and physical stability. The melting points of cancrinite products prepared in accordance with this process are in the range of 900° C to 1200° C. Several changes in the composition of the products occur before the melting point is reached, however. Zeolytic water is initially lost up to temperatures of about 300° C. Where there is unreacted clay in the product, loss of hydroxyl water from the clay is observed over the temperature range of 450° C to 650° C. Only at temperatures above about 700° C are the trapped nitrate and nitrite salts decomposed to oxide. A change in crystal structure of the product occurs at high temperatures. Samples heated from 800° C to 1000° C give an X-ray diffraction pattern corresponding to nepheline.

Thermal conductivity measurements for clay-waste slurries and dried cancrinite product were made as representative of the possible extremes. The values for the actual solid product, depending on the particular process, will be somewhere in between. For synthetic waste and commercial clays thermal conductivities for clay-waste slurries and dried cancrinite product are provided in Table III below:

TABLE III

| Sample | Temperature ° C | Thermal Conductivity BTU (hr) (ft²) (° F/ft) |
|---|---|---|
| Kaolin slurry (1.0 g/ml mixture) | 24.9 | 0.670 |
| Bentonite slurry (1.0 g/ml mixture) | 24.7 | 0.458 |
| Kaolin cancrinite | | |
| Product (dry) | 25.3 | 0.140 |
| Product (dry) | 44.0 | 0.158 |
| Product (dry) | 74.7 | 0.161 |
| Benton cancrinite | | |
| Product (dry) | 26.3 | 0.114 |
| Product (dry) | 56.4 | 0.185 |
| Product (dry) | 69.0 | 0.175 |

These values are near those of dried salt cake (0.1 to 0.6 BTU/ (hr) (ft²) (°F/ft) and are high enough so that large temperature gradients should not occur in the cancrinite product made from stored Hanford Purex-type wastes.

Pure cancrinite is quite hard (5 to 6 on Mohs' scale). The solid cancrinite product of this process is, however, a mixture of small cancrinite crystals and unreacted clay (e.g., kaolin which has a hardness of 2.0 to 2.5 on Mohs' scale). Thus, while the hardness of this product is limited to that of the clay, it is hard enough to be safely handled and transported.

In order to make a mechanically stronger product, harderners or binders may be incorporated into the product either by addition to the reaction mixture or to the solid product. Suitable additives to the reaction mixture are CaO, silica gel, sodium silicate or mixtures thereof. The greatest increase in hardness results from the addition of a mixture of CaO and $SiO_2 \cdot xH_2O$ where $x$ is variable. Various inorganic cements, including portland cement, may be used to bind the mineral crystals together to make a stronger product. Organic polymers, such as styrene, methyl-methacrylate, in mineral-monomer mixtures may also be used to provide hard, rugged products. A very dramatic increase, for example, in the hardness of dried cancrinite products occurs after treatment with tetraethyl silicate (TES). Soaking the cancrinite-clay mixture in TES for several hours, either at room temperature or at 100° C, gives a product which is difficult to scratch and which is more water-resistant. Samples treated with TES do not appear to soften even when soaked in water for months. Binders appear to be most effective when the cancrinite solid product is made from fired clays in which the clay structure has been destroyed. Unreacted clay tends to cause the cement to crumble when air-dried, possibly from the shrinkage of the clay upon drying.

The presence of fission products, such as $^{137}Cr$, $^{90}Sr$, $^{106}Ru$, etc., over a limited concentration range does not affect the formation of the thermally stable solid product. Reactions of bentonite and synthetic waste spiked with large amounts of $Cs^+$ and $Sr^{++}$ gave only cancrinite, even when the concentrations were many times greater than those expected in reprocessing wastes, such as Purex-type wastes. At concentrations above about 0.01 and 0.37 M $Sr^{++}$ and $Cs^+$, respectively, solid cancrinite was formed but the product was found to contain other phases. Data on the effect of fission product concentrations on formation of cancrinite are given in Table IV below:

TABLE IV

Effect of $Cs^+$ and $Sr^{++}$ Concentration in Synthetic Waste on Reaction Products[a]

| Sample | $Cs^+$, $Sr^{++}$, Conc. | Products |
|---|---|---|
| 1 | 0.37 M $Cs^+$ | Cancrinite |
| 2 | 0.75 M $Cs^+$ | Cancrinite + unknown |
| 3 | 1.50 M $Cs^+$ | Cancrinite + unknown |
| 4 | 2.25 M $Cs^+$ | Cancrinite + pollucite |
| 5 | 0.10 M $Sr^{++}$ | Cancrinite |
| 6 | 0.38 M $Sr^{++}$ | Cancrinite+$Sr_3Al_2O_6 \cdot 6H_2O$ |
| 7 | 1.00 M $Sr^{++}$ | Cancrinite + $Sr_3Al_2O_5 \cdot 6H_2O$ + $SrCO_3$ |
| 8 | 1.30 M $Sr^{++}$ | Cancrinite + $Sr_3Al_2O_6 \cdot 6H_2O$ + $SrCO_3$ |

[a]20 ml of solution were reacted with 5.00 of bentonite at 100° C for 10 days.

The clay appears to go through a gel phase, then partial dissolution and finally, precipitation of the mineral crystals from solution. The solid product is a salt-filled, sodium aluminosilicate with the radioactive isotopes trapped in the aluminosilicate framework structure. This framework structure is made up of 11-hedra cages with salts and water molecules trapped inside. A comparison of the X-ray diffraction patterns of the clay reaction product with three other types of cancrinites is given in Table V.

TABLE V

| Natural Cancrinite[a] | | Synthetic Cancrinite | | Natrodavyne[c] | | Clay Reaction product | |
|---|---|---|---|---|---|---|---|
| dÅ | I/I. | dÅ | I/I. | dÅ | I/I. | dÅ | I/I. |
| 11.0 | 30 | — | — | — | — | — | — |
| 6.32 | 60 | — | — | 6.38 | 70 | 6.27 | 50 |
| 5.47 | 10 | — | — | — | — | — | — |
| 4.64 | 80 | 4.70 | 80 | 4.64 | 10 | 4.68 | 60 |
| 4.13 | 30 | — | — | — | — | — | — |
| 3.75 | 10 | — | — | — | — | — | — |
| 3.65 | 50 | 3.67 | 80 | 3.68 | 100 | 3.63 | 80 |
| 3.22 | 100 | 3.25 | 100 | 3.21 | 10 | 3.23 | 100 |
| 3.03 | 30 | — | — | — | — | — | — |
| 2.97 | 30 | — | — | — | — | — | — |
| — | — | 2.82 | 16 | 2.85 | 25 | — | — |
| 2.73 | 60 | 2.76 | 35 | — | — | 2.73 | 35 |
| 2.61 | 50 | 2.63 | 30 | 2.60 | 35 | 2.61 | 30 |
| 2.56 | 60 | 2.57 | 16 | — | — | 2.58 | 35 |

[a]ASTM Powder Diffraction File, Card No. 20-257.
[b]ASTM Powder Diffraction File, Card No. 15-734.
[c]ASTM Powder Diffraction File, Card No. 25-469.

It may be observed that the match of the clay reaction products of this invention with natural and synthetic cancrinite is very good.

Two methods of obtaining leach rate values were used. In the first of these, crystalline cancrinite or nepheline powder was suspended in distilled water and the cesium content of the leach water was measured at various intervals. Leach rates were calculated from the fraction of cesium leached from the sample and the BET surface area of the powder. In the second method (IAEA Method), the crystalline powders were molded into massive shapes using a binder; and the leach rates were calculated from the fraction of cesium leached and the *geometric surface area* of the sample. Values from the first method are approximately $10^3$ less than from the second method.

Having described the invention in general fashion the following examples are given to indicate with greater particularity the process parameters and techniques.

EXAMPLE I

To demonstrate the fixation of radioactive isotopes in a solid cancrinite product, weighed amounts of dried Wyoming bentonite (Robinson Laboratories) were placed in polypropylene bottles along with various volumes of Purex-type waste (Hanford tank 103-BY recycle having nominal molar composition of $Al^{3+}$ — 2.70; $NO_3^-$ — 1.88; $NO_2^-$ — 1.95; $OH^-$ — 5.16 with $4.60 \times 10^5$ Ci/liter $^{137}Cs$). The mixture was then thoroughly mixed. The bottles were then sealed and placed in a boiling water bath (100° C) for 7 days.

Solid products were filtered hot, washed with 50 ml of distilled water, and air-dried. The dry product was weighed and analyzed for $^{137}Cs$. Measurements of $^{137}Cs$ were also made for the filtrates and wash solution in order to obtain a material balance.

The results are given in Table VI below:

TABLE VI

Effect of Clay/Liquid Waste Ratio on Percent of $^{137}Cs$ Fixed in Cancrinite

| Clay/Liquid Waste Ratio, g/ml | Weight of Clay, g | Volume of Wastes, ml | Percent $^{137}Cs$ Fixed in Cancrinite Product |
|---|---|---|---|
| 0.05 | 1.0 | 20 | 8.9 |
| 0.25 | 5.0 | 20 | 30.3 |
| 0.50 | 10.0 | 20 | 69.3 |
| 0.70 | 7.0 | 10 | 91.0 |
| 1.0 | 10.0 | 10 | 99.5 |
| 1.4 | 14.0 | 10 | 99.9 |
| 1.6 | 8.0 | 5 | 99.9 |

TABLE VI-continued

Effect of Clay/Liquid Waste Ratio on Percent of $^{137}Cs$ Fixed in Cancrinite

| Clay/Liquid Waste Ratio, g/ml | Weight of Clay, g | Volume of Wastes, ml | Percent $^{137}Cs$ Fixed in Cancrinite Product |
|---|---|---|---|
| 2.0 | 10.0 | 5 | 99.9 |

These data show that between 0.70 and 1.0 gram of bentonite per milliliter of waste solution will fix the $^{137}Cs$ in the solid product.

EXAMPLE II

Reactions of clays with synthetic waste spiked with strontium indicate that essentially all of the strontium is fixed in the final product. The reaction conditions and results of these experiments are given in Table VII. The mixtures were heated at 100° C for a minimum of 6 days. After this time the products were filtered, washed with distilled water, air-dried and then analyzed for Sr.

TABLE VII

Strontium Fixation in Cancrinite

| Sample No. | Weight of Sr, g | Clay | Synthetic Waste Solution, ml | Percent Sr Fixed |
|---|---|---|---|---|
| 44 | 1.65 | 1.0 g kaolin | 10 | 92 |
| 85 | 1.65 | 1.0 g bentonite | 10 | 100 |
| 126 | 0.17 | 5.0 g bentonite | 20 | 100 |
| 127 | 0.66 | 5.0 g bentonite | 20 | 100 |
| 128 | 1.65 | 5.0 g bentonite | 20 | 96 |

EXAMPLE III

To demonstrate that radioactive wastes (synthetic and actual) can be converted to a solid stable product with very low solubility, 1.0 g of bentonite and 3.0 g of kaolin were reacted at 100° C with (a) 20 ml of synthetic waste having a nominal molar composition of $Na^+$ — 11.0; $Al^{3+}$ — 1.8; $NO_3^-$ — 2.0; $NO_2^-$ — 1.0; $SO_4^=$ — 0.05; $CO_3^=$ — 0.10; and $OH^-$ — 5.0. Reaction products were washed with distilled water and air-dried. Radioactive cancrinite samples (b) from treatment of Hanford tank 103-BY liquid with bentonite (see Table VI) were also used in this example.

Leach rates for the products for (a) and (b) were measured at various hours of leaching. The bulk leach rates were determined from the equations:

synthetic products:

$$\text{Bulk leach rate} = \frac{(\text{fraction of } Na^+ \text{ leached})(\text{Sample weight})}{(\text{Surface area})(\text{time})}$$

Radioactive Cancrinite:

$$\text{Bulk leach rate} = \frac{(\text{fraction of } ^{137}Cs \text{ leached})(\text{Sample weight})}{(\text{Surface area})(\text{time})}$$

The results are given in Tables VIII and IX below:

TABLE VIII

Bulk Leach Rates for Cancrinite Products

| Sample No. | Cancrinite Source | Surface Area[a] $M^2/g$ | Bulk Leach Rate, $g/cm^2$ - day ($\times 10^8$) 25 hr. | 95 hr | 192 hr. | 432 hr. |
|---|---|---|---|---|---|---|
| 32 | Kaolin + Syn. Waste | 6.1 | 93 | 9.0 | 6.5 | 4.1 |
| 72 | Bentonite + Syn. waste | 38.4 | 27 | 3.7 | 1.7 | 0.76 |

[a]from BET surface area determinations.

Both cancrinite products show very low leach rates. The rates for the bentonite product appear to be lower than for the kaolin product. This is mainly due to the high surface area, since the fraction leached is higher for the bentonite product during all leaching periods. The kaolin product, therefore, appears to be slightly superior with regard to leachability.

TABLE IX

Bulk Leach Rates of Radioactive Cancrinite Products

| Sample No. | Clay/Liquid Waste Ratio, g/ml | Bulk Leach Rate[a] g/cm² - day (×10⁹) 72 hr. | 240 hr. |
|---|---|---|---|
| 1 | 0.05 | 78 | 2.2 |
| 2 | 0.25 | 110 | 13. |
| 3 | 0.50 | 9.3 | 4.1 |
| 4 | 0.70 | 6.5 | 2.3 |
| 5 | 1.0 | 2.9 | 0.98 |
| 6 | 1.4 | 1.2 | 0.15 |
| 7 | 1.6 | 1.0 | 0.21 |
| 8 | 2.0 | 1.3 | 0.49 |

[a]based on assumed surface area of 20 M²/g.

It will be seen from the data given in Table IX that the leach rates for the radioactive cancrinite are approximately an order of magnitude lower than for the synthetic products. This is attributed to there being a slower rate of diffusion of $Cs^+$ into the leachant compared with $Na^+$.

EXAMPLE IV

To demonstrate the fixation of cesium and strontium in a solid nepheline product 25 grams of clay and 25 milliliters of synthetic waste solution (same composition as in Example III) spiked with cesium and strontium were mixed and reacted at 100° C. The crystalline product using either kaolin or bentonite clay was identified as cancrinite. The dried cancrinite products were then fired at 1000° C for 4 hours. The crystal product from this treatment was identified as nepheline. These nepheline products were ground into powder and leach rates of powders were measured. The results of these measurements are given in Table X.

TABLE X

Leach Rates of Nepheline Products

| Sample No. | Type of Clay Used | Surface Area of Leach Sample cm²/g [a] | Leach Rate, g/cm² - day 3 days | 18 days |
|---|---|---|---|---|
| 3BR | kaolin | $1.6 \times 10^4$ | $1.6 \times 10^{-7}$ | $2.7 \times 10^{-8}$ |
| 7BR | bentonite | $<1.0 \times 10^4$ | $>9.0 \times 10^{-7}$ | $>9.0 \times 10^{-8}$ |

[a]based on BET surface area measurements.

The leach rates given in Table X are calculated from the amount of cesium leached. Calculations of leach rates based on the amount of strontium leached are about a factor of 10 lower. These very low leach rates show that cesium and strontium are effectively immobilized in the nepheline crystal structure.

EXAMPLE V

To demonstrate the immobilization of radioactive wastes which are in a dry salt cake form, various ratios of clay and synthetic salt cake were mixed together in a blender along with cesium and strontium hydroxide spikes. Both kaolin (Georgia Kaolin Co. — Astra Glaze) and bentonite (Georgia Kaolin Co. - MC-101) clays were used. The synthetic salt cake composition is given in Table XI below.

TABLE XI

Composition of Synthetic Salt Cake

| Component | Percent by Weight |
|---|---|
| $NaNO_3$ | 60 |
| $NaNO_2$ | 20 |
| $Al(OH)_3$ | 10 |
| NaOH | 10 |

After being thoroughly blended, the mixture was heated to 900° C – 1000° C for approximately 15 minutes. The product (a loose powder in most experiments) was then analyzed by X-ray diffraction. Nepheline was identified as the principal crystalline product in each of the experiments given in Table XII below:

TABLE XII

Effect of Clay/Salt Cake Ratio on Product Identity

| Clay Type | Percent Synthetic Salt Cake in Mixture | Product Identity |
|---|---|---|
| Kaolin | 10 | Poor Nepheline |
| Kaolin | 20 | Poor Nepheline |
| Kaolin | 30 | Good Nepheline |
| Kaolin | 40 | Good Nepheline |
| Bentonite | 10 | Poor Nepheline |
| Bentonite | 20 | Poor Nepheline |
| Bentonite | 30 | Good Nepheline |
| Bentonite | 40 | Good Nepheline |

It may be seen that the crystallinity of nepheline improved as the amount of synthetic salt cake in the mixture increased.

EXAMPLE VI

Massive samples (bricks) were prepared for leaching by adding binders to the powdered products prepared in Example V, pressing the mixtures into cylindrical shapes and then allowing the binders to cure. Two binders were studied: Type III portland cement and a ZnO — $Na_2SiO_3$ solution mixture. Thirty grams of powdered product was mixed with either 15 g portland cement plus 10 ml $H_2O$ or 4.0 g ZnO plus 10.0 ml 41°Be $Na_2SiO_3$. The cement binder was cured by allowing the mixture to sit in a sealed container for about 1 week. The ZnO — $Na_2SiO_3$ binder was cured by heating at 200° C for 30 minutes.

The samples were then leached with distilled water for 32 days according to the proposed International Atomic Energy Agency standard procedure (see Hespe, E. P., "Leach Testing of Immobilized Radioactive Waste Solids — A Proposal for a Standard Model," Atomic Energy Review, pp. 195–207, Vol. 9, 1971). The percent of cesium and strontium leached from the samples after 25 days are given in Table XIII below as a function of clay types, salt cake content and binder type.

TABLE XIII

Percent of Cesium and Strontium Leached From Nepheline Product After 25 Days

| Clay Type | Percent Salt Cake | Portland Cement Binder | | ZnO - $Na_2SiO_3$ Binder | |
|---|---|---|---|---|---|
| | | Cesium | Strontium | Cesium | Strontium |
| Kaolin | 10 | 5.91 | 6.08 | 5.91 | 0.17 |
| Kaolin | 20 | 4.22 | 0.54 | 1.30 | 0.20 |
| Kaolin | 30 | 2.60 | 0.35 | 1.38 | 0.07 |
| Kaolin | 40 | 3.22 | 0.32 | 5.50 | 0.06 |
| Bentonite | 10 | 2.66 | 2.10 | 0.19 | 0.10 |
| Bentonite | 20 | 1.68 | 1.19 | 0.03 | 0.06 |
| Bentonite | 30 | 2.15 | 0.72 | 0.42 | 0.03 |
| Bentonite | 40 | 6.37 | 0.46 | 10.92 | 0.01 |

The data show that cesium and strontium are effectively fixed in the crystalline nepheline matrix. Leach rates based on the fraction of cesium leached vary from $3.3 \times 10^{-2}$ to $7.8 \times 10^{-6}$ g/cm² — day after 32 days. Based on the fraction of strontium leached, leach rates are smaller by factors of 1.5 to 10. These values were calculated from geometric surface areas of massive, bound samples rather than actual, BET surface area.

Regarding the solid mineral forms of this invention, nepheline has several important advantages over cancrinite; namely, (1) the volume of solid product per entrapped radioactive ion is smaller, i.e., the increase in volume of the radioactive waste where the radioactive salts are entrapped in nepheline is about 45% whereas the increase in volume of the radioactive waste entrapped in cancrinite is about 300% (for salt cake) and (2) the leach rates (I.A.E.A. method) for radioactive entrapped salts in nepheline is lower than those for cancrinite, $10^{-3}$ to $10^{-5}$ g/cm² — day and $10^{-2}$ to $10^{-4}$ g/cm² — day, respectively.

From the foregoing it will be apparent to those skilled in the art that immobilization of radioactive wastes either as a dry salt cake or aqueous solutions may be effected in solid nepheline. For nepheline immobilization it is believed that the reaction may be carried out with any sodium salt (e.g., $NaNO_3$, $NaNO_2$, etc.) which decomposes to $Na_2O$ supplying caustic for the reaction at temperatures below 800° C.

An example of this reaction is given by the following equation:

$$2NaNO_3 + Al_2Si_2O_7 \rightarrow 2NaAlSiO_4 + N_2O_5. \quad (3)$$

This is an important feature of the nepheline process inasmuch as, for example, at Hanford, Wash., the current plans are to convert all of the highly caustic, sodium nitrate-containing liquids to anhydrous salt cake. Hence, by this finding greater flexibility is achieved in the waste management program; namely, where the radioactive wastes are still in the aqueous form, i.e., sodium nitrate-containing liquids, the wastes may be converted either to solid, virtually insoluble cancrinite or nepheline, or where the radioactive wastes have already been converted to salt cake, reaction with aluminosilicate clays at temperatures of about 800° C will entrap the dissolved radioactive salts within the aluminosilicate crystallographic matrix nepheline.

In summary, it will be apparent to those skilled in the art that we have discovered a process which is uniquely specific for converting aqueous solutions or slurries of sodium nitrate — containing, caustic, liquid radioactive wastes to a safe, solid, stable, salt-filled mineral form (either cancrinite or nepheline) with the radioactive isotopes being entrapped in the aluminosilicate framework structure of the mineral. Obviously, many variations in the process may be made without departing from the scope of the invention which is limited only by the attached claims.

What is claimed is:

1. A method for converting sodium nitrate-containing, caustic, liquid radioactive wastes to a solid relatively insoluble, thermally stable, salt-filled radioactive mineral form consisting essentially of the steps of reacting powdered aluminum silicate clays selected from the group consisting of kaolin, bentonite, dickite, halloysite and pyrophillite with aqueous solutions or slurries of said caustic, liquid, radioactive wastes which have a sodium hydroxide concentration of at least about 3 to about 7 M at a temperature of about 30° C to 100° C to thereby entrap radioactive isotopes in the crystalline aluminosilicate framework structure of cancrinite reaction product, air drying said cancrinite reaction product and firing the resultant product at a temperature of at least 600° C to form said solid, salt-filled, radioactive mineral form.

2. The method of claim 1 wherein said sodium nitrate-containing, caustic, liquid radioactive wastes comprise an aqueous waste solution having a molar composition of $Al^{3+}$ — 2.70; $NO_3^-$ — 1.88; $NO_2^-$ — 1.95; $OH^-$ — 5.16, said powdered aluminum silicate comprises kaolin, the stoichiometry of said reaction requires two moles of NaOH per mole of cancrinite formed, and said mineral form comprises nepheline.

3. The method of claim 1 wherein said aluminum silicate clay comprises bentonite which has added to it one mole $NaAlO_2$ per mole bentonite and the stoichiometry of said reaction requires two moles of NaOH per mole of cancrinite formed.

4. The method of claim 1 wherein said mineral form comprises nepheline.

5. The method of claim 1 wherein said powdered aluminum silicate clay is fired bentonite clay and the clay/waste solution ratio is within the range of 0.05 to 2.0 grams bentonite per ml of waste solution.

6. The method of claim 1 wherein said powdered aluminum silicate clay is fired kaolin clay and the clay/waste solution ratio is within the range of 0.05 to 1.0 gram kaolin per ml of waste solution.

7. The method of claim 1 wherein said sodium nitrate-containing, caustic, liquid radioactive wastes contain fission products of $^{137}Cs$ and $^{90}Sr$, said fission products having a concentration up to about 0.37 M and 0.01 M, respectively.

* * * * *